US008567779B2

(12) United States Patent
Hantel et al.

(10) Patent No.: US 8,567,779 B2
(45) **Date of Patent: *Oct. 29, 2013**

(54) APPARATUS FOR PRESSING FLAT MATERIALS ONTO A TRANSPORT MODULE

(75) Inventors: Ulrich Hantel, Berlin (DE); Wolfgang Muhl, Hohen Neuendorf (DE); Dieter Woelm, Ludwigsfelde OT Gross Schulzendorf (DE); Axel Ortmann, Berlin (DE)

(73) Assignee: Francotyp-Postalia GmbH, Birkenwerder (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/402,240

(22) Filed: Feb. 22, 2012

(65) Prior Publication Data

US 2012/0200029 A1 Aug. 9, 2012

Related U.S. Application Data

(63) Continuation-in-part of application No. 12/252,697, filed on Oct. 16, 2009, now Pat. No. 8,136,813.

(30) Foreign Application Priority Data

Dec. 17, 2007 (DE) ..... 10 2007 060 789

(51) Int. Cl.
*B65H 5/02* (2006.01)

(52) U.S. Cl.
USPC ..... 271/275; 198/626.1

(58) Field of Classification Search
USPC ..... 271/3.21, 6, 275, 198; 198/626.1, 198/626.3, 626.5, 626.6, 688.1
See application file for complete search history.

(56) References Cited

U.S. PATENT DOCUMENTS

| | | | | |
|---|---|---|---|---|
| 4,744,554 | A | 5/1988 | Kulpa et al. | |
| 4,746,234 | A | 5/1988 | Harry | |
| 5,467,709 | A | 11/1995 | Salomon | |
| 5,813,326 | A | 9/1998 | Salomon | |
| 5,949,444 | A | 9/1999 | Geserich et al. | |
| 6,431,778 | B1 | 8/2002 | Coudray et al. | |
| 6,467,901 | B2 | 10/2002 | Von Inten | |
| 6,550,994 | B2 | 4/2003 | Manduley | |
| 6,585,433 | B2 | 7/2003 | Davies et al. | |
| 6,776,089 | B2 | 8/2004 | Kanda | |
| 8,136,813 | B2 * | 3/2012 | Hantel et al. | 271/275 |
| 2009/0153636 | A1 | 6/2009 | Hantel et al. | |

FOREIGN PATENT DOCUMENTS

| | | | |
|---|---|---|---|
| DE | 3734268 | A1 | 4/1988 |
| DE | 233 101 | B5 | 10/1995 |
| DE | 196 05 014 | C1 | 3/1997 |
| DE | 196 05 015 | C1 | 3/1997 |
| DE | 20 2007 019 194 | U1 | 2/2011 |
| EP | 1 079 975 | B1 | 3/2001 |
| EP | 1 170 141 | A2 | 1/2002 |
| WO | 99/44174 | A1 | 9/1999 |

* cited by examiner

*Primary Examiner* — Michael McCullough
(74) *Attorney, Agent, or Firm* — Laurence A. Greenberg; Werner H. Stemer; Ralph E. Locher

(57) ABSTRACT

An apparatus for pressing flat materials onto a transport module with a transport belt includes a holding carrier for pressing elements being disposed under a feed table. At least one of the pressing elements is mounted on the holding carrier with a multiplicity of individual resilient or sprung constituent parts, or a multiplicity of pressing elements are disposed on the holding carrier below the transport belt in a transport direction. The pressing elements can protrude through an opening in the feed table, in order to provide suitable pressure from below on the transport belt of the transport module.

16 Claims, 5 Drawing Sheets

APPARATUS FOR PRESSING FLAT MATERIALS ONTO A TRANSPORT MODULE

CROSS-REFERENCE TO RELATED APPLICATION

This is a continuation-in-part application of U.S. patent application Ser. No. 12/252,697, filed Oct. 16, 2008; the application also claims the priority, under 35 U.S.C. §119, of German patent application No. DE 10 2007 060 789.1, filed Dec. 17, 2007; the prior applications are herewith incorporated by reference in their entirety.

BACKGROUND OF THE INVENTION

Field of the Invention

The invention relates to an apparatus for pressing flat materials onto a transport module of a printing apparatus which is controlled by a microprocessor and has, in a printing position, a printing module which does not move during printing. The flat materials are fed in to the printing apparatus on a feed table and are pressed onto a transport belt in a supporting region counter to the force of gravity. The invention is used in printing apparatuses which are controlled by a microprocessor and is suitable for franking machines and other mail processing units.

An apparatus which employs a transport principle and has a belt that lies at the top and a sprung back pressure apparatus that lies underneath, between which an item of mail is clamped, is known from East German Patent Application DD 233 101 B5, corresponding to U.S. Pat. No. 4,746,234. However, a thermal transfer ink ribbon which is used is unsuitable as a transport belt. The thermal transfer ink ribbon is disposed above a feed table, over which the items of mail are transported in a lying manner downstream in the direction of the mail flow. The feed table has openings, through which a driven back pressure roller engages on the item of mail.

U.S. Pat. No. 6,550,994 has disclosed a franking machine having a transport apparatus for items of mail, by way of which transport apparatus the letters are transported through the franking machine through the use of a transport belt which lies at the top and a plurality of sprung levers which are disposed underneath. Similar subject matter is also apparent from U.S. Pat. No. 5,813,326, U.S. Pat. No. 6,776,089 and U.S. Pat. No. 6,585,433. The transport belt is mounted in the manner of a loop on rollers and does not allow the printing module or a part thereof to protrude into the region between the rollers. The width of the transport belt is relatively small and corresponds to approximately 1 inch. The extent of the housing transversely with respect to the transport direction of the items of mail is relatively great in comparison. An additional factor is that a second printing position is provided for printing franking strips which are rolled up on reels and which are unrolled for printing. That second printing path causes higher production costs.

U.S. Pat. No. 5,467,709 has already disclosed a printing apparatus for an inkjet franking machine, in which a franking imprint is printed onto an item of mail through the use of an inkjet print head during approximately horizontal letter transport. The inkjet print head is disposed in a stationary manner behind a guide plate in a recess for printing. A circulating transport belt, which is likewise disposed on the side of the guide plate, serves as a transport apparatus. A supporting and pressing apparatus having a plurality of rollers is disposed on the other side opposite the guide plate, with the result that an item of mail which is fed in is clamped between the rollers of the supporting and pressing apparatus and the circulating transport belt. However, the apparatus cannot avoid oblique running of the printing media. An insufficiently tensioned transport belt or a not exactly parallel alignment of the axles of those rollers, on which the transport belt circulates, is sufficient to involve the above-mentioned risk. The supporting and pressing apparatus is very complicated as a result of the multiplicity of rollers of that apparatus.

German Patent DE 196 05 015 C1, corresponding to U.S. Pat. No. 5,949,444, has already proposed an embodiment of a printing apparatus of an inkjet franking machine which is the JetMail® apparatus of the applicant of the instant application, Francotyp-Postalia AG & Co. That embodiment carries out a franking imprint during non-horizontal, approximately vertical letter transport through the use of an inkjet print head which is disposed in a stationary manner behind a guide plate in a recess. A circulating transport belt having pressing elements for the items of mail (letters up to 20 mm thickness, DIN (German Standard) B4 format) or for franking strips, which are configured in such a way that they can be adhesively bonded to packages of any desired thickness, serves as a transport apparatus. The printing medium (letter, package, franking strip) is clamped between the pressing elements and the guide plate.

Transport and drive apparatuses of relatively simple construction without a back pressure apparatus (see German Patent DE 196 05 014 C1) or with a back pressure apparatus (see International Publication No. WO 99/44174) in the vicinity of the printing region using at least one inkjet print head, have also already been proposed. In International Publication No. WO 99/44174, the latter is disposed downstream of an intake roller pair in the transport direction of the mail flow, with the upper roller being driven and the lower back pressure roller being sprung. A further roller pair downstream of the inkjet print head in the mail flow direction close to an ejection device likewise exerts a force on the printing medium. The printing region is spaced apart from the force transmission region of one of the roller pairs by more than one radius of the respectively driven roller. Although the printing information can in principle be changed in all regions by digital printing, the print quality becomes lower as a higher transport speed is selected. In particular, during the use of two inkjet print heads, an offset in the printed image (butting or connection error) can occur along a printed length in the transport direction. The offset makes evaluation of the printed image by machine difficult. The action of the force of the further roller pair downstream of the inkjet print head in the direction of the mail flow close to the ejection device leads to different distances being covered and therefore to the butting or connection error in the printed image in the case of two inkjet print heads which are offset with respect to one another. The print quality which is required in the context of current programs of mail deliverers (for example, the Information Based Indicia Program of the USPS) would therefore only be possible to achieve at a low printing speed. The low thickness of the printing media which can be printed by a printing apparatus that is constructed simply in that way is also disadvantageous.

European Patent EP 1 079 975 B1, corresponding to U.S. Pat. No. 6,431,778, has disclosed an apparatus for printing characters on a predefined location of one side of a flat recording medium, and has also disclosed a franking machine which is equipped correspondingly. A transport belt is disposed firstly on the inkjet print head side and secondly forms an unsuspended supporting device for that side of a flat recording medium (object, item of mail, envelope) which is to be printed. A back pressure apparatus supports the flat object from below. In that back pressure apparatus, a belt rolls around at least two other rollers, at least one of which is not suspended.

An apparatus which is known from European Patent EP 1 170 141 B1, corresponding to U.S. Pat. No. 6,467,901, for printing a printing medium in the printing region, uses a driven transport drum and nondriven back pressure rollers in the force transmission region or, as an alternative, a nondriven back pressure conveyor belt. In the printing region, a stationary inkjet print head prints the printing medium which is moved downstream, with the inkjet print head being disposed axially with respect to the transport drum. The printing region is preferably approximately 1 inch and is spaced apart from the force transmission region, with the spacing of the most remote pixel from the edge of the transport drum being smaller than the radius of the circumference of the transport drum. However, the slight approximately linear contact of that surface of the item of mail which is to be printed with the transport drum and an intake wheel for items of mail which is disposed at a spacing are disadvantageous. The intake wheel is driven by the transport drum through a toothed belt. This causes a $\Delta x$ offset of the dots in the printed image. A $\Delta y$ offset of the dots in the printed image results orthogonally with respect thereto, in particular in the case of items of mail having a very large format. Moreover, the construction causes high production costs.

In the market segment of franking machines having small to medium mail item throughputs, a compact transport apparatus for items of mail is required, in which the items of mail are not to be contaminated, however, by free spraying. In the case of horizontal mail item transport, it is assumed that an ink cartridge is disposed above a printing window in the z-direction of a Cartesian coordinate system counter to the direction of gravity. During printing, at least one inkjet print head ejects ink droplets in the direction of gravity, counter to the z-direction, and those ink droplets fly through the printing window. The printing window is disposed at the edge of a transport belt in the y-direction in a housing part, with the transport belt transporting a flat material which is to be printed at the edge past the at least one print head in the transport direction x during printing.

German Utility Model DE 20 2007 019 194 U1 corresponding to published U.S. patent application 2009/0153636 A1, which is the U.S. Patent Application to which this application claims priority, describes a device, which uses a transport belt-brushing system for pressing flat materials. This system works sufficiently well for "normal mail items", such as letters, even over a period of several years. The transport force is realized by an overlap between the transport belt and the brush elements upon simultaneous movement of the transport belt. The brush elements are fastened in a brush body, which is situated in a holding carrier. The holding carrier is pressed against the transport belt by spring elements in order to realize the pressure force by the brush elements. The brush elements are permanently deformed by these pressure forces, which leads to transport problems in the case of very thin mail items (for example, franking strips).

SUMMARY OF THE INVENTION

The invention relates to a pressing apparatus having resilient elements and is applicable to all arrangements which use resilient pressing elements which are not to undergo permanent deformation. The invention allows for simplification, in particular, of a transporting or printing apparatus which is provided for use in a post franking system or in a franking machine. When flat products are referred to below, this should not exclude, however, paper strips, items of mail or other products for which the counterpressure device is also suitable.

German design patent DE 20 2007 019 194 U1 makes known an apparatus for pressing flat materials onto a transport module which uses a transport belt-brush system. This system functions sufficiently well even over a longer period for items of mail with a sufficient thickness, such as, for example, for letters. The pressing force is realized by an over-travel between the transport belt and the brush elements with the transport belt moving at the same time. The brush elements have holders. The holders are fastened in a brush body. This latter is mounted in a holding carrier. A further prototype known from DE 20 2007 019 194 U1, FIG. 4, has a first spring system which has the aforementioned brush elements and a second spring system which is coupled mechanically to the first system. The second spring system consists of a base plate, which is fastened on a floor plate by means of spacer bolts and is resilient with respect to said floor plate.

For the pressing, brush elements are used as resilient elements which generate a pressing force F1 which increases in a non-linear manner. The second spring system presses the holding carrier with the brush elements counter to the force of gravity against the transport belt with a pressing force F2 which increases in a linear manner. An overtravel is also generated when a flat product is not situated between the transport belt and the pressing apparatus (idle state). The overtravel is designed such that there is certainly a pressing force on the transport belt in the idle state even when component tolerances of the pressing apparatus occur. The deflection of the pressing apparatus is effected by means of spring force counter to the force of gravity and is defined to the overtravel of approximately 2 mm by defining means. The pressing force F2, in this case, is so great that in the idle state an overloading and consequently permanent deforming of the brush elements of the pressing apparatus is caused, the applicable formula being:

$$F1 \ll F2.$$

In the idle state, the spring force F1 becomes less and less with the duration of the deformation as a result of the material, which leads to transport problems in the case of very thin flat products, in particular in the case of franking strips.

The object to be achieved was to develop a pressing apparatus with resilient elements, said pressing apparatus being suitable for items of mail with different thicknesses and ensuring reliable transport especially of very thin flat products, in particular franking strips, over a long period without deforming the brush elements.

It has been recognized that the brush elements of a brush body, which form a first spring system, are particularly well suited for transporting thin flat products if the brush elements are not deformed in the idle state of the pressing apparatus.

A pressing apparatus, which is provided with resilient elements, in particular brush elements, is now coupled mechanically to a double spring system instead of to a single spring system, said double spring system provides the necessary pressing force on the one hand and on the other hand also optimizes the pressing force such that persistent deformation of the brush elements in the idle state of the pressing apparatus is prevented. The brush elements are the resilient elements of a first spring system, which are deformed from a force which corresponds to a minimum pressing force Fl min of the first spring system. Their pressing force increases in a non-linear manner with the increase in the thickness of the products which are transported along a transport path in the operating state of the transport belt and pass between the transport belt and the pressing apparatus. It has been ascertained empirically that persistent deformation of the brush elements in the idle state is prevented if the brush elements act on the transport belt with a pressing force that is less than a minimum pressing force Fl min of the first spring system. In the idle state of the pressing apparatus, consequently, a second spring system acts on the transport belt with the pressing force F2 by means of the first spring system in order to absorb those forces which could deform the brush elements, the following being applicable to the pressing forces:

$$F1\ min > F2min.$$

The minimum pressing force F2 of the second spring system, in this case, is selected by and large lower than the minimum pressing force F1 min of the first spring system, thereby ensuring that the minimum pressing force F2 acting in the idle state of the pressing apparatus on the transport belt remains below the sum of the deforming forces DB* of all the brush elements B1*, B2*, . . . , Bi*, . . . , Bn*:

$$F2min < F1min = \Sigma DB^* = DB1^* + DB2^* + \ldots + DBi^* + \ldots + DBn^*$$

In the idle state of the pressing apparatus there is no product present in the transport path, unlike in the operating state thereof. A flat product is transported in the operating state. On account of the thickness of the flat product, the holding carrier is deflected in the direction of the force of gravity. A spring force acts counter to the deflection of the holding carrier. Said spring force is defined by defining means which are arranged between the base plate and the floor plate. The second spring system is preloaded as a result of the defining. In addition, there are provided at least two first stop elements which define the travel of the base plate to the floor plate in the direction of the force of gravity. As a result of a spring constant R2 of the spring force of all the compression springs together, the pressing force F2 increases in a proportional manner to the deflection. A path which is defined by the stop elements is covered in the case of the deflection. The aforementioned path corresponds to an average thickness of the flat product (item of mail). This path is referred to as travel.

If individual brush elements are initially deformed when meeting the edge of a flat product and during the transport thereof, the deflection thereof is transmitted as a result overall to the deflection of the holding carrier up to a predetermined travel of s1=2 mm. The pressing force F2 of the second spring system is overall lower than the minimum pressing force F1 min of the first spring system. With the mechanical coupling of the two spring systems, no more deformation of the brush elements whatsoever occurs in the idle state as long as the pressing force overall remains below the sum of the deforming forces Σ DB*. Up to a travel of the holding carrier in the direction of the force of gravity corresponding to a first thickness of a flat product, for example an item of mail of up to 2 mm, only the pressing force F2 of the second spring system is active on the item of mail. In the case of the travel s1=2 mm of the holding carrier in the direction of the force of gravity corresponding to the first thickness of an item of mail, the first stop of the arrangement is reached, defining the travel which can occur between the base plate and the floor plate of the pressing apparatus. On account of the defining of the travel, the pressing force F1 of the first spring system acts instead of the pressing force F2 of the second spring system. As a result of the deforming of the brush elements, the pressing force F1 increases in a non-linear manner from the minimum pressing force F1 min with the thickness of the flat product as long as the minimum pressing force F3min of a further third spring system is not reached. Even items of mail of average thickness can be transported in the operating state without persistent deformation of the brush elements occurring as long as a pressing force of the first spring system, at which the reversible deformation changes into irreversible deformation, is not exceeded. In the case of the brush elements used in the exemplary embodiment, it occurs with the first thickness of a flat product. The further increase in the pressing force with the thickness of the flat product is defined at a second thickness of the flat product. An optimum pressing force F1 opt has been ascertained empirically at this second thickness.

In the operating state of the pressing apparatus, a further spring system becomes active for items of mail from the second thickness, said further spring system acting with a minimum pressing force F3min=F1 opt when the optimum pressing force F1 opt of the first spring system is reached. The pressing force continues to increase from F3min in a linear manner with the thickness of the flat product. The proportionality factor is referred to as spring constant R3 (corresponding to $R_{42}$ in the description below) and is much greater than the spring constant R2 (corresponding to $R_{37}$ in the description below).

Consequently, this produces a mechanically coupled double spring system which acts on the brush body. Thin to thick flat products (items of mail) are able to be transported thereby, the following being applicable to the pressing forces:

$$F3 > F3min = F1opt > F1 > F1min = F2max > F2 > F2min.$$

Each of the brush elements Bi* consists of a bundle of brush hairs or brush bristles and in the pressing force/thickness diagram has non-linearity of the deforming force DBi* which is based on the increasing friction of the brush hairs or brush bristles together when they are deformed, the friction increasing with the deforming thereof. At the optimum pressing force F1 opt, brush elements are certainly momentarily deformed in the operating state of the pressing apparatus, however without the deformation being irreversible. Rather, the deformation is still reversible.

It is accordingly another object of the invention to provide an apparatus that ensures a secure transport of very thin mail items, in particular franking strips, over a long period of time without causing a permanent deformation of the brush elements. This problem is solved by using a so-called dual spring system, which, on the one hand, provides the required pressure force, and, on the other hand, optimizes the pressure force such that a remaining or permanent deformation of the brush elements is prevented.

It is also another object of the invention to provide an apparatus for pressing flat materials onto a transport module of a printing apparatus which is controlled by a microprocessor, which overcomes the hereinafore-mentioned disadvantages of the heretofore-known devices of this general type and in which the printing apparatus ensures high print quality with low production costs and a medium mail item throughput. The reliability of the printing apparatus is to be as high as possible and the printing offset in the x-direction and y-direction is to be so low that the imprint can be read by machine. In this case, firstly postcards and secondly C4 sized letters having a mail item thickness of up to 10 mm are to be processed.

With the foregoing and other objects in view there is provided, in accordance with the invention, in a microprocessor-controlled printing apparatus including a transport module, a printing module not moving during printing in a printing position, a feed table on which flat materials are fed in to the printing apparatus, and a transport belt onto which the flat materials are pressed in a supporting region counter to the force of gravity, an apparatus for pressing the flat materials onto the transport module. The pressing apparatus comprises a holding carrier for pressing elements disposed under the feed table. At least one of the pressing elements is mounted on the holding carrier with a multiplicity of individual resilient or sprung components or constituent parts and protrudes through an opening formed in the feed table, or a multiplicity of the pressing elements are disposed on the holding carrier below the transport belt in a transport direction and protrude through the opening formed in the feed table, to provide suitable pressure from below on the transport belt of the transport module.

The transport module is disposed above the feed table and has a transport belt for items of mail or flat printing materials in a manner which is known per se. Suitable pressing from below onto the transport belt of the transport module is realized by the pressing elements which are disposed below the transport belt in the transport direction. In this case, the pressing elements are mounted on a holding carrier. The pressing surface area of the pressing elements is to be as great as possible. It has been ascertained empirically that scarcely any joining error occurs in the printed image in the case of a multiplicity of pressing elements which act over their full surface area. A joining error is produced during printing of a continuous perpendicular line by way of two half-inch inkjet print heads which are disposed offset with respect to one another, as a result of a transport difference of the flat material or item of mail with respect to the two half-inch inkjet print heads. The holding carrier can be mounted in a resilient or sprung manner, in order to compensate for letter thicknesses of up to 10 mm. Pressing elements which run in and out have a special geometry. The pressing elements can be disposed on the holding carrier in such a way that they are inclined or at right angles with respect to the transport belt. As an alternative, the individual pressing elements can also be replaced by a complete pressing body.

Other features which are considered as characteristic for the invention are set forth in the appended claims.

Although the invention is illustrated and described herein as embodied in an apparatus for pressing flat materials onto a transport module, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
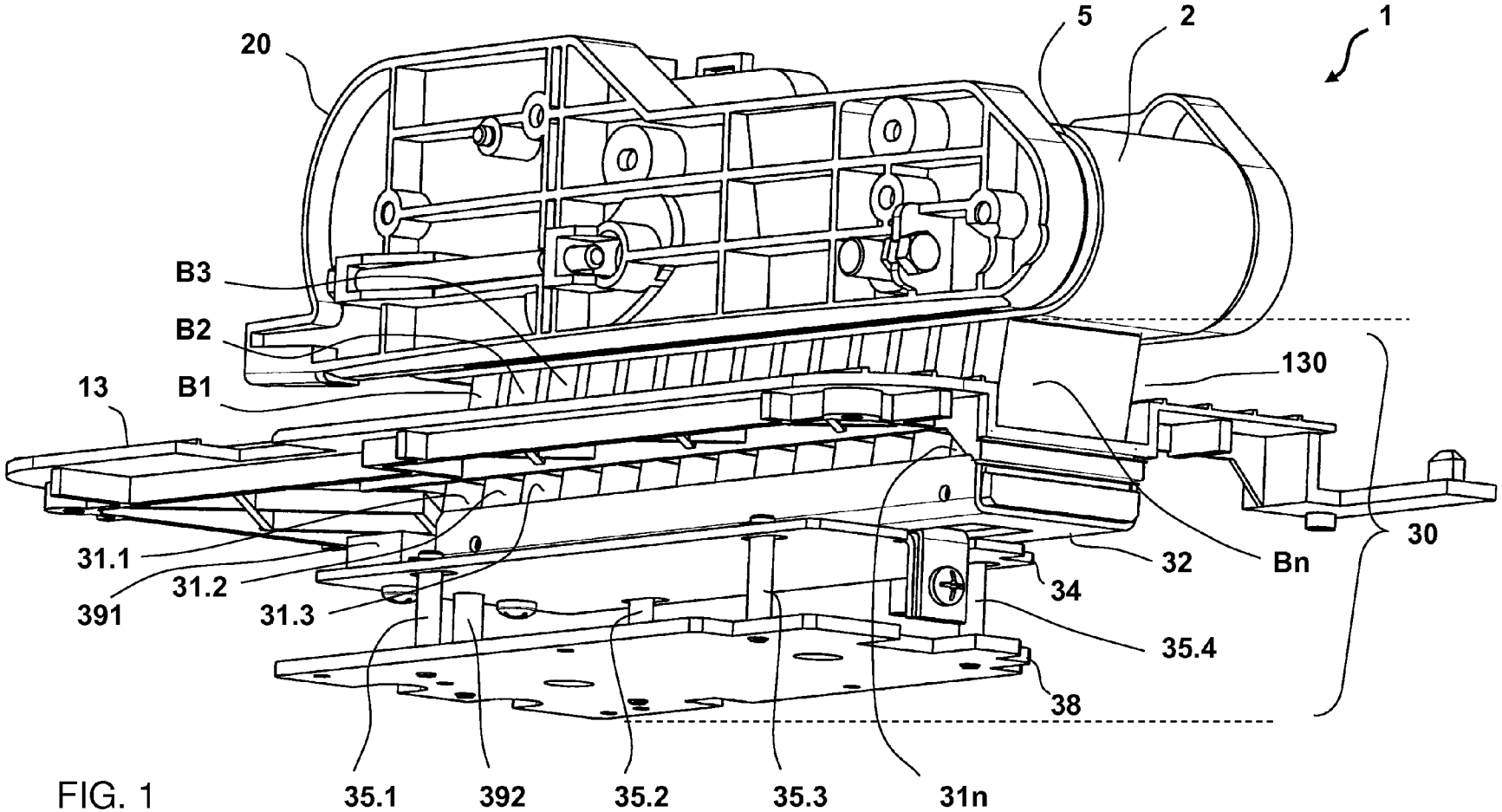
FIG. 1 is a perspective view of a transport apparatus having a transport module without a printing module, having a feed table and having a pressing apparatus.

Referring now to the figures of the drawings in detail and first, particularly, to FIG. 1 thereof, there is seen a perspective view of a transport apparatus 1 from the front at the bottom right. The transport apparatus 1 is provided for flat materials or items of mail and is equipped with a transport module without a printing module, with a feed table 13 and with a pressing apparatus 30. The transport module includes a roller carrier 20 having a driven roller 5 and further (concealed) deflection rollers, and having a transport belt 2 which is configured as a flat belt.

The transport module is disposed above the pressing apparatus 30, which protrudes partially through an opening 130 in the feed table 13. The pressing apparatus 30 includes protruding brush elements B1, B2, B3, . . . Bn and a holding carrier 32 having a multiplicity of holders 31.1, 31.2, 31.3 to 31.n for the brush elements. The pressing apparatus 30 also includes a slide-in unit 34 to 38 without spring elements which generates a back pressure from below on the brush elements. The spring elements can be omitted, in particular, in the case of very flat materials or thin items of mail which are to be transported, if the brush elements B1, B2, B3, . . . Bn are sufficiently resilient or sprung and flexible per se. The brush elements are provided in order to adapt themselves to the underside of a non-illustrated flat material or item of mail without impeding the transport.

Figure 2:
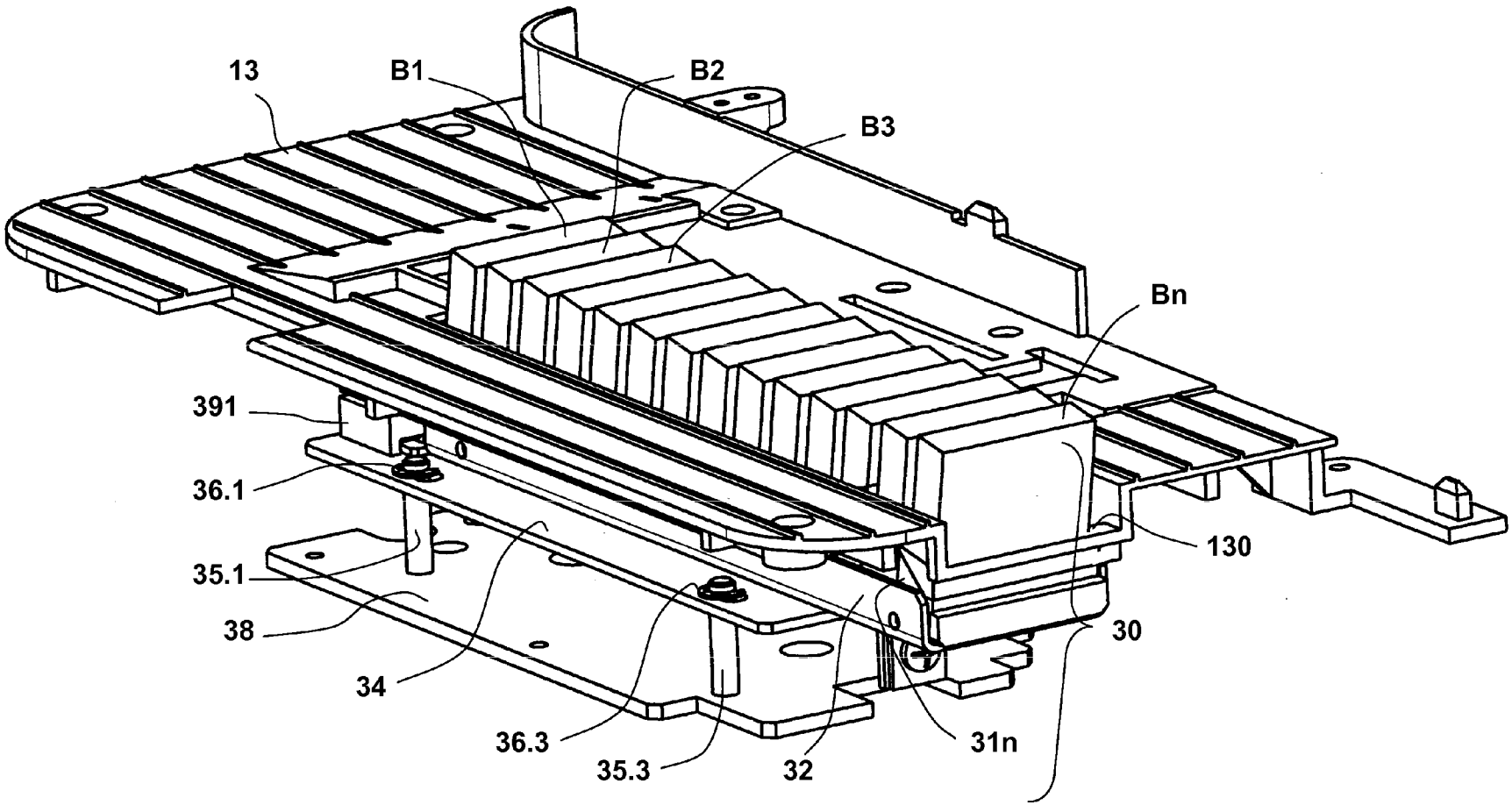
FIG. 2 is a perspective view of the pressing apparatus which is disposed on the feed table, having a holding carrier and having an unsprung slide-in unit.

FIG. 2 shows a perspective view of the pressing apparatus 30 from the front at the top right. The pressing apparatus 30 is disposed on the feed table 13. The pressing apparatus 30 includes the holding carrier 32 and the unsprung slide-in unit 34 to 38. The holding carrier 32 is equipped with the multiplicity of brush elements B1, B2, B3 to Bn and with the corresponding holders for the latter. The brush elements protrude through the opening 130 in the feed table 13. A first brush element B1 is disposed on an inlet side of a mail flow and a last brush element Bn is disposed on an outlet side of the mail flow. Each brush element is fastened in a corresponding holder. Thus, for example, the brush element Bn is fastened in the holder 31*n*. The holder and therefore each brush element can be inclined in the transport direction, as has been shown in FIG. 2, but they can also not be inclined.

The slide-in unit 34 to 38 is shown without spring elements, is disposed below the holding carrier 32 and is configured for supporting the holding carrier or for pressing and clamping the latter and a non-illustrated flat material or item of mail from below against the flat belt of the transport module in a manner which is not shown.

Figure 3:
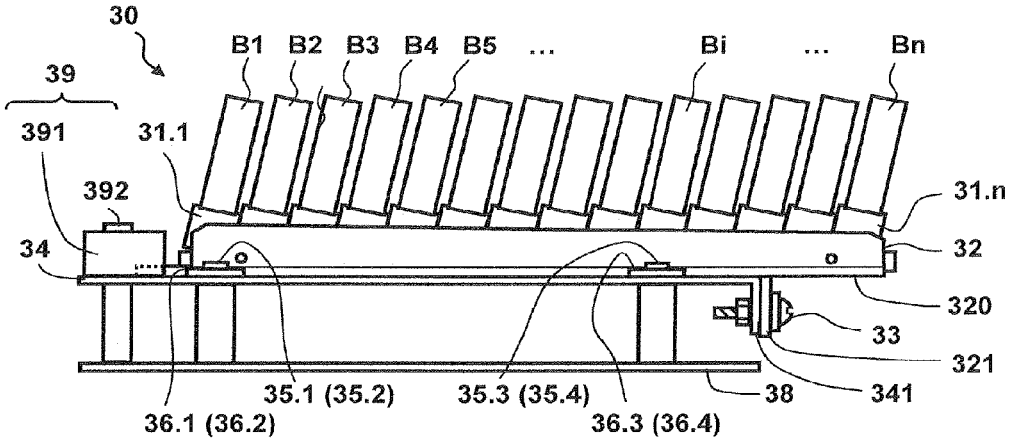
FIG. 3 is a front-elevational view of a first embodiment of the pressing apparatus having an unsprung slide-in unit.

FIG. 3 shows a front view of a first embodiment of the pressing apparatus 30 with the holding carrier 32 having the multiplicity of brush elements B1, B2, B3, . . . , Bi, . . . , Bn and an unsprung slide-in unit 34 to 38. The holding carrier 32 has the multiplicity of brush elements B1, B2, B3, . . . , Bi, . . . , Bn and holders 31.1, 31.2, 31.3 . . . , 31*i*, . . . 31*n* for the brush elements. The holders are fastened in the holding carrier 32 which has a base plate 320, from which a first bracket 321 has been machined and is angled away at right angles. The latter and two horns on the mail flow inlet side of the base plate 320 (shown in dashed lines) serve to fasten the unsprung slide-in unit 34 to 38.

A second bracket 341, which is connected force-lockingly and form-lockingly to the first bracket 321 of the holding carrier 32, is bent away to the bottom from a base plate 34 of the unsprung slide-in unit 34 to 38. A screw connection is produced, for example, through the use of a metal screw 33 which, starting from the mail flow outlet side, is plugged through a hole in the first bracket 321, is screwed into a hole with a thread in the second bracket 341 and is optionally secured by a lock nut. A force-locking connection is one which connects two elements together by force external to the elements, as opposed to a form-locking connection which is provided by the shapes of the elements themselves.

An adjusting and fastening piece 391, having two holes which have been machined into the above-mentioned piece and point in the opposite direction to the transport direction, is provided on the mail flow inlet side of the base plate 34. The holding carrier 32 is plugged into the holes with its two horns (shown in dashed lines). The adjusting and fastening piece 391 is fastened on the base plate 34 by a non-illustrated screw connection and has an opening for an adjusting and fastening bolt 392. The adjusting and fastening bolt 392 is fastened on a floor plate 38, for example likewise by screwing. The base plate 34 is fastened on the floor plate 38 through spacer bolts 35.1, 35.2, 35.3 and 35.4, for example likewise by screwing. As an alternative, riveting or spot welding of the spacer bolts is possible. In each case, one locking washer 36.1, 36.2, 36.3 and 36.4 is used on the base plate 34 as a releasable fastening device. The concealed spacer bolts and fastening device have been labeled by designations between parentheses. The adjusting and fastening bolt 392 and the adjusting and fastening piece 391 form an adjusting and fastening device 39.

Figure 4:
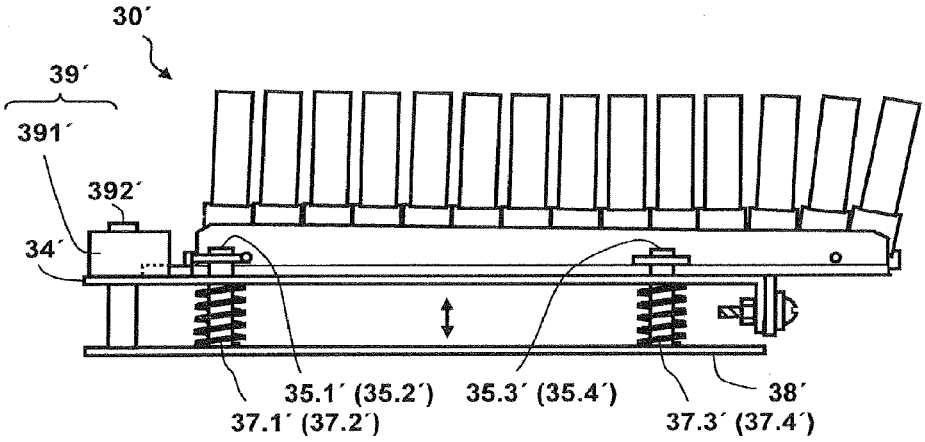
FIG. 4 is a front-elevational view of a second embodiment of the pressing apparatus having a sprung slide-in unit.

FIG. 4 shows a front view of a second embodiment of the pressing apparatus 30' with a holding carrier 32' having a multiplicity of brush elements and a sprung slide-in unit. The brush elements likewise are disposed in the form of a brush, as has already been explained by using FIG. 3. The construction of the slide-in unit is also comparable to the embodiment shown in FIG. 3, but with the addition of spiral springs 37.1', 37.2', 37.3' and 37.4' which are each plugged onto a respective one of bolts 35.1', 35.2', 35.3' and 35.4'. A base plate 34' in each case has one opening for one of the bolts 35.1', 35.2', 35.3' and 35.4', as a result of which the bolts can slide through at one end, with a force having to be applied counter to the spring action. The spacer bolts 35.1', 35.2', 35.3' and 35.4' are fastened at their other end on the floor plate 38', for example likewise by screwing, riveting or spot welding. An adjusting bolt 392' and an adjusting piece 391' form an adjusting device 39'.

The adjusting and fastening device 39 and the adjusting device 39' can also be configured differently as an alternative. Other spring elements 37 can also be used for suspending the pressing apparatus 30 in the case of thicker items of mail, while continuing to proceed from the basic concept that the pressing elements have a spring action per se.

Figure 5:
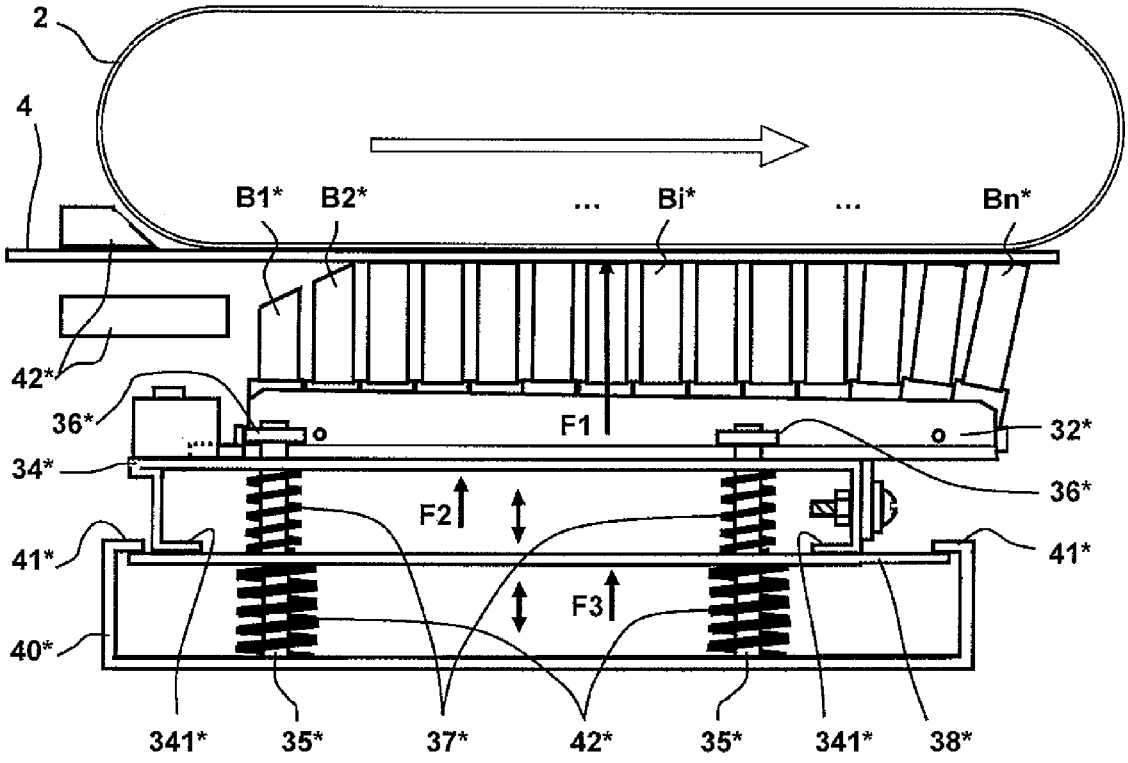
FIG. 5 is a front-elevational view of a third embodiment of the pressing apparatus having a sprung slide-in unit.

FIG. 5 shows a front-elevational view of a third embodiment of a pressing apparatus 30* having a sprung slide-in unit 34* to 38*. The problem of preventing the permanent deformation of the brush elements while ensuring the secure transport of very thin mail items, in particular franking strips, over a long period of time is solved by providing a so-called dual spring system. The dual spring system on one hand provides the required pressure force, and, on the other hand, optimizes the pressure force such that a remaining deformation of the brush elements B1*, B2*, B3*, . . . , Bi*, . . . , Bn* is prevented.

The dual spring system consists of the already known spring elements 37* between the base plate 34* and the floor plate 38*, which hitherto served for pressing the holding carrier 32* onto the transport belt, as well as further spring elements 42*, which are arranged between the floor plate 38* and the chassis 42*. Preferably at least one additional spring element would be provided behind each one that is shown in FIG. 5. In the case where one additional spring element is provided behind each one that is shown in FIG. 5, there would be four springs associated with reference numeral 37* and four springs associated with reference numeral 42* (although only two springs are shown in each case).

The spring constant $R^*_{37}$, which is obtained from the sum of the spring elements 37*, however, has been selected to be essentially lower than in DE 20 2007 019 194 U1, to ensure that, in the idle state of the machine, the pressure forces remain below the deformation force provided by the sum of the brush elements B1*, B2*, B3*, . . . , Bi*, . . . , Bn*. For the spring constants $R^*_B$ and $R^*_{37}$, the following condition applies:

$$R^*_B > R^*_{37},$$

where $R^*_B$ is the spring constant from the sum of the brush elements B1*, B2*, B3*, . . . , Bi*, . . . , Bn*; and $Ru^*_{37}$ is the spring constant from the sum of the spring elements 37*. The further spring system, arranged between the floor plate 38* and the chassis 40*, now ensures that the brush elements B1*, B2*, B3*, . . . , Bi*, . . . , Bn* are pressed against the transport belt. For the spring constants $R^*_{42}$, $R^*_B$ and $R^*_{37}$, the following conditions apply:

$$R^*_{42} > R^*_B > R^*_{37},$$

where $R^*_{42}$ is the spring constant from the sum of the spring elements 42*; $R^*_B$ is the spring constant from the sum of the brush elements B1*, B2*, B3*, . . . , Bi*, . . . , Bn*; and $R^*_{37}$ is the spring constant from the sum of the spring elements 37*. This solution is applicable for all configurations, which use elastic pressing elements not to be subjected to permanent deformation. A stop hook 41 is provided for the floor plate 38*.

FIG. 5 shows the pressing apparatus 30* in the operating state. A white arrow points in the direction of transport of a flat product 4. The brush body has the brush elements B*=B1*, B2*, . . . , Bi*, . . . , Bn*. The brush elements B1* and B2* are inclined in order to facilitate the insertion, above all, of a thicker product into the gap between the transport belt 2 and the pressing apparatus. The holding carrier 32* (brush body) is coupled mechanically to a double spring system. The double spring system consists of the already known spring elements 37*, which are arranged between a base plate 34* and a floor plate 38*, which, up to now, have already served for pressing the brush elements onto a transport belt 2 and which in total have a spring constant $R^*_{37}$, as well as of further spring elements 42* which are arranged between the floor plate 38* and the chassis 40* and in total have a spring constant $R^*_{42}$. The spring constant $R^*_{37}$ of the spring elements 37*, however, is now selected to be substantially lower than in the case of the previous solution according to DE 20 2007 019 194 U1, thereby ensuring that in the idle state of the printing apparatus the pressing forces remain below the deforming force of the brush elements B*. With the spring elements 37*, the spring system is now spring-mounted in a manner that is softer than the first spring system with the brush elements B* or the further third spring system with the spring elements 42*.

FIG. 5 shows that the base plate 34* has been deflected in the direction of the force of gravity. A spring force, which is applied by at least two compression springs 37*, acts counter to the deflection of the base plate 34*. The aforementioned spring force is defined by defining means, consisting, for example, in each case of a locking washer 36* and spacer bolt 35*, the base plate 34* having an opening for guiding through the spacer bolt 35*. The second spring system is preloaded as a result of the defining means. The spring elements 37* have been compressed corresponding to the thickness of the flat product 4 such that the locking washer 36* and the base plate 34* are spaced apart from each other.

At least two stop elements 341* are mounted on the base plate 34* and are formed correspondingly for defining the travel in the direction of gravity such that a stop on the floor plate 38* is reached when the thickness of the flat product 4—in the manner shown—reaches or exceeds a first thickness.

At least two defining elements 41* are arranged on the chassis 40* and define the movement of the floor plate 38* in the idle state of the pressing apparatus and in the operating state—represented in FIG. 5—for thin flat products. The action of the further spring system is consequently defined counter to the direction of gravity.

As an alternative to one of the first stop elements 341* which are mounted on the base plate, a first stop element—in a variant not shown—can be mounted on the floor plate 38* and can strike the base plate 34* if the thickness of the product reaches or exceeds the first thickness.

Figure 6:
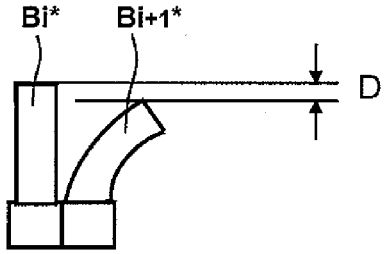
FIG. 6 is a diagramatic view showing the deformation of one brush element relative to another brush element.

FIG. 6 shows the deformation of a brush element Bi+1* compared to a brush element Bi*. The deformation of brush elements occurs if a flat product 4 that is thicker than that shown in FIG. 1 is pressed.

The further spring system—shown in FIG. 5—is mounted between the floor plate 38* and the chassis 40* and can only become active when the pressing force increases above a threshold value F1 opt, which presupposes a corresponding thickness of the flat product.

A lock 42* with a through-opening for items of mail which defines the thickness of a product allowed through to a defined maximum thickness, for example 10 mm, is provided upstream of the pressing apparatus.

Figure 7:
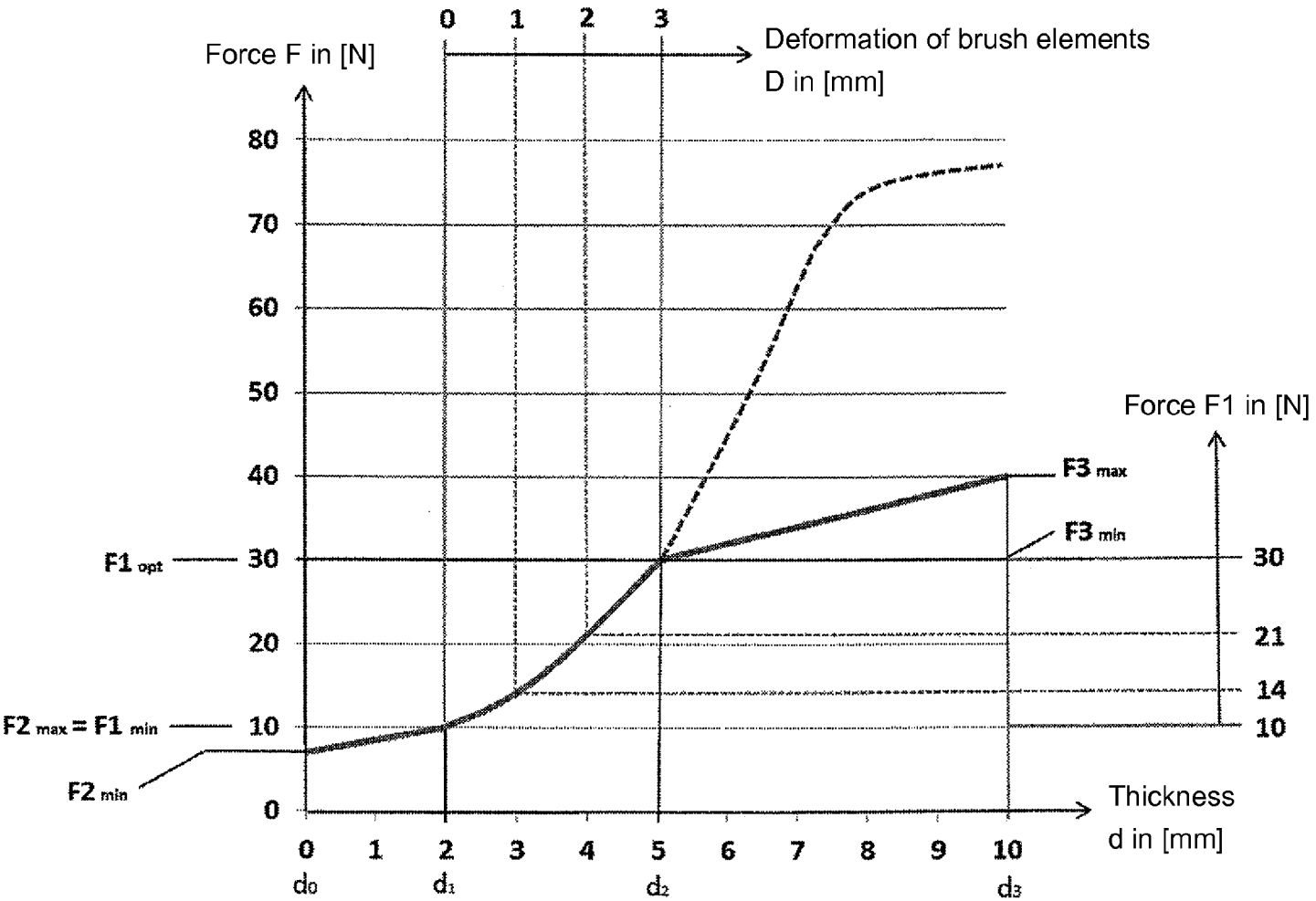
FIG. 7 is a pressing force/thickness diagram.

FIG. 7 shows a pressing force/thickness diagram. The increase in the curve shown of the pressing force F2 is m2=(F1min-F2min)/(d1-d0) and is equal to the spring constant R2. The increase in the curve shown of the pressing force F3 is m3=(F3max-F1 opt)/(d3-d2) and is equal to the spring constant R3. In the case of the aforementioned exemplary embodiment, F3min=F1 opt=30 N. In practice, this is achieved through the spring force of four compression springs 42*.

Within the aforementioned pressing force/thickness diagram, a further ordinate for the pressing force F1 is shown at the right-hand edge of the figure and a further abscissa for representing the deforming of the brush elements is shown at the top edge of the figure. Once at least the first stop element 341* has been struck, in the case of the brush used in the exemplary embodiment, just a deformation of the brush elements up to the value D=3 mm is possible. It can be seen that the pressing force acting on the item of mail continues to increase in a non-linear manner with the deforming of the brush elements.

Because, particularly in the case of thicker products, the increase in the curve would become too steep under the action of the pressing force F1 applied by the brush elements, the further spring system is necessary, said further spring system preventing the pressing force acting on the item of mail from continuing to increase in a non-linear manner with the thickness of the item of mail. In this sense, the further spring system acts in a defining manner for the increase in the pressing force. Without the use of the further spring system with the spring constant $R^*_{42}$, the brush elements would continue to be deformed in such a case, i.e. d>5 mm, with the result that the pressing force acting overall on the item of mail would continue to increase in a non-linear manner. A curve corresponding to the aforementioned case has been recorded by the broken line in FIG. 7.

The pressing force F1, with which all the brush elements in total act on the item of mail, would exceed the pressing force F3 of the further spring system, which can lead to irreversible deforming of the brush elements. On the other hand, the pressing force F3 should increase with a defined increase because, as a rule, it is necessary to compensate for the effect of gravity in the case of a heavier weight, in particular in the case of large-format items of mail such as, for example format B4.

It is provided that a holding carrier 32* or a brush body is mounted on the base plate 34*.

The invention is not restricted to the embodiment explained here as further other designs of the invention can obviously be developed or used which—proceeding from the same basic concept of the invention—are included by the enclosed claims.

In the exemplary embodiments which were explained in the preceding text, the invention was explained by using brush elements. However, other pressing elements are not to be ruled out thereby, in order to realize the invention. Synthetically produced pressing elements in strip, lamellar, pin or comb form may likewise be suitable. A greater number of individual resilient or sprung constituent parts or components of the pressing elements reduce an offset in the transport direction and therefore the occurrence of joining errors. For this reason, brush elements are discussed or the invention is explained by using them in a representative manner for other embodiments.

The number of individual bristles or hairs of the brush elements is higher, at least transversely with respect to the transport direction, than in the case of the individual strips of a strip or lamellar form.

Brush elements which run in and out have a special geometry. The brush elements can be disposed on the holding carrier in such a way that they are inclined or at right angles with respect to the transport belt. As an alternative, the individual brush elements can also be replaced by a complete brush body.

Fourteen brush elements have been shown in the above-mentioned examples, but that is not to rule out the fact that more or fewer brush elements could be used. In the extreme case, a brush element having an excess size or a brush which cannot be divided into brush elements is used. The number of bristles or brush hairs per brush element lies in the two figure to four figure range. Instead of animal hair, a piece of fur with a pronounced preferential fur stroke direction can be used, with the stroke direction having to point in the transport direction. However, only synthetically produced fur products or brush elements are preferably used. A lower number can be sufficient in the case of synthetic bristles with a special geometry, but their number is still much higher even in this case than is customary in usual pressing elements nowadays.

With regard to the first and second embodiments shown in FIGS. 3 and 4, there is provision for the brush elements to act with a first spring constant R1 on the item of mail and for the spring elements of the slide-in unit to act with a second spring constant R2 on the item of mail, where in this case, the following is true: R1 <<R2. However, that condition does not apply to the third embodiment shown in FIG. 5.

The brush elements include a multiplicity of synthetic or animal hairs or bristles. Special spring characteristics can be produced for the brush elements B1 to Bn which are different than those of the spring elements 37, in particular due to their profile and the gradient of the thickness of the synthetic hairs which decreases toward the tip.

A mail item transport apparatus is equipped with a transport belt which is known per se, preferably a driven wide tensioned flat belt. The latter is guided past closely under or on parts of the printing module over deflection rollers of a roller carrier.

The roller carrier 20 of the transport apparatus is disposed in a horizontal and stationary manner in the machine with respect to the pressing apparatus 30 in the z-direction, with the pressing apparatus 30 pressing the item of mail which is fed in onto the transport belt. The transport belt is a flat belt which acts on a part of the surface of the items of mail with a predefined adhesion friction in the transport region. That part of the surface is not printed but is close to the printing region.

In contrast with this, the adhesion friction of the pressing apparatus 30 is minimized at least in a preferential direction, with the latter coinciding with the transport direction.

The invention is not restricted to the present embodiment per se. Rather, a number of units are conceivable within the scope of the claims. The units are used and are included by the present claims in a manner which proceeds from the same basic concept of the invention.

The invention claimed is:

1. In a microprocessor-controlled printing apparatus including a transport module, a printing module not moving during printing in a printing position, a feed table on which flat materials are fed in to the printing apparatus, and a transport belt onto which the flat materials are pressed in a supporting region counter to the force of gravity, an apparatus for pressing the flat materials onto the transport module, the pressing apparatus comprising:

a holding carrier disposed under the feed table; and pressing elements for protruding through an opening formed in the feed table to provide suitable pressure from below on the transport belt of the transport module;

at least one of said pressing elements being mounted on said holding carrier with a multiplicity of individual resilient components or a multiplicity of said pressing elements being disposed on said holding carrier below the transport belt in a transport direction.

2. The apparatus according to claim 1, which further comprises a slide-in unit, said holding carrier being fastened on said slide-in unit, and said pressing elements being spring elements having an inherent spring action.

3. The apparatus according to claim 1, wherein said holding carrier is resiliently mounted under the feed table.

4. The apparatus according to claim 3, which further comprises a sprung slide-in unit on which said holding carrier is fastened.

5. The apparatus according to claim 1, wherein said pressing elements have a geometry permitting them to run in and out.

6. The apparatus according to claim 5, wherein said pressing elements running in and out are brush elements having a multiplicity of bristles or hairs with said geometry.

7. The apparatus according to claim 1, wherein said pressing elements are disposed on said holding carrier at an incline or at right angles relative to the transport belt.

8. The apparatus according to claim 1, wherein said individual pressing elements are part of a complete pressing body having a multiplicity of individual resilient components of said pressing elements.

9. The apparatus according to claim 1, which further comprises a multiplicity of synthetically produced bristles or hairs disposed in a brush element or in a complete brush body with a preferential direction, said holding carrier being mounted or adjusted to cause said preferential direction to coincide with said transport direction.

10. The apparatus according to claim 1, wherein said pressing elements are produced synthetically in a strip, lamellar, pin, comb or brush shape.

11. A pressing apparatus having resilient elements which generate a pressing force F1, in particular brush elements of a brush body, to which a first spring system is coupled mechanically, which first spring system has a number of spring elements which are arranged between a base plate and a floor plate, characterized in that:

the brush elements of the pressing apparatus are coupled mechanically to a double spring system;

the double spring system consists of the first spring system and a further spring system that is coupled mechanically to the first spring system;

wherein the first spring system is preloaded overall in an idle state to a predetermined minimum pressing force F2min and in an operating state, for flat products up to a first thickness, exerts a pressing force F2 that increases linearly with the thickness;

wherein in the idle state a pressing force is exerted that is smaller than is provided by the brush elements, in that at least two first stop elements are provided which define a travel of the base plate to the floor plate in the direction of the force of gravity, wherein after a striking of the at least two first stop elements, the brush elements provide in total a minimum pressing force F1min, which corresponds to the sum of deforming forces DB of the brush elements in the idle state of the pressing apparatus; and wherein, in the operating state, for flat products from the first thickness up to a second thickness, the brush elements exert a non-linearly increasing pressing force up to an optimum pressing force F1opt onto the flat product and in that the further spring system is preloaded overall to a predetermined pressing force F3min, which is equal to the optimum pressing force F1opt of the brush elements and in the operating state, for flat products from a second thickness, exerts a pressing force F3 which increases linearly with the thickness;

wherein the following is applicable to the pressing forces:

$$F3 > F3\text{min} = F1\text{opt} > F1 > F1\text{min} = F26\text{max} > F2 > F2\text{min}.$$

12. The pressing apparatus as claimed in claim 11, characterized in that at least one of the at least two first stop elements is mounted on the base plate and is formed correspondingly for defining the travel such that a stop on the floor plate is reached.

13. The pressing apparatus as claimed in claim 11, characterized in that the further spring system that is coupled mechanically to the first spring system consists of further spring elements which are arranged between the floor plate and a chassis.

14. The pressing apparatus as claimed in claim 13, characterized in that a defining element, which is arranged on the chassis, defines a movement of the floor plate and consequently the action of the further spring system counter to the direction of the force of gravity, as a result of which the further spring system is preloaded to the predetermined pressing force F3min.

15. The pressing apparatus as claimed in claim 11, characterized in that the travel of the base plate to the floor plate of the pressing apparatus is defined for flat products from the first thickness of d1 =2 mm.

16. The pressing apparatus as claimed in claim 11, characterized in that a holding carrier or a brush body is mounted on the base plate.

* * * * *